US006544152B2

(12) United States Patent
Rosati

(10) Patent No.: US 6,544,152 B2
(45) Date of Patent: Apr. 8, 2003

(54) EXERCISE DEVICE

(76) Inventor: Frank Rosati, 5401 Valley Way, Niagara Falls, ON (CA), L2E 1X5

( * ) Notice: Subject to any disclaimer, the term of this patent is extended or adjusted under 35 U.S.C. 154(b) by 29 days.

(21) Appl. No.: 09/814,745

(22) Filed: Mar. 23, 2001

(65) Prior Publication Data

US 2002/0137609 A1 Sep. 26, 2002

(51) Int. Cl.[7] ..... A63B 21/02

(52) U.S. Cl. ..... 482/126; 482/129; 482/130; 482/907

(58) Field of Search ..... 482/121–131, 482/907, 140, 78–80, 82, 105, 139

(56) References Cited

U.S. PATENT DOCUMENTS

| | | | | |
|---|---|---|---|---|
| 821,783 A | | 5/1906 | Clease | |
| 1,969,165 A | | 8/1934 | Turner | |
| 4,591,150 A | | 5/1986 | Mosher | |
| 5,029,850 A | * | 7/1991 | van Straaten | 272/137 |
| 5,076,576 A | | 12/1991 | Johnston | |
| 5,125,649 A | * | 6/1992 | Fuller | 482/123 |
| 5,137,503 A | * | 8/1992 | Yeh | 482/125 |
| 5,269,737 A | | 12/1993 | Sobotka | |
| 5,556,368 A | | 9/1996 | Akin | |
| 5,653,665 A | | 8/1997 | Neeley | |
| 5,674,163 A | | 10/1997 | Sennett | |
| 5,695,437 A | | 12/1997 | Olschansky et al. | |
| 5,816,985 A | | 10/1998 | Ho | |
| 5,846,170 A | | 12/1998 | Ho | |
| 5,993,361 A | | 11/1999 | Paoli et al. | |

* cited by examiner

*Primary Examiner*—Nicholas D. Lucchesi
*Assistant Examiner*—Lori Baker Amerson

(57) ABSTRACT

The invention provides an exercise device including an elongate anchor bar assembly, an elongate foot bar assembly movable relative to the anchor bar assembly having at least a foot restrainer for restraining a user's feet, a foot coupling assembly for connecting the foot bar assembly to the anchor bar assembly, a pair of hand coupling members, and hand grip. The foot coupling assembly is attached to the anchor bar assembly and to the foot bar assembly. Each hand coupling member has a secured end and a free end, and each secured end is attached to one of the anchor bar assembly and the foot bar assembly. The free ends are attached to the hand grip, so that the hand grip is movable relative to the anchor bar assembly and the foot bar assembly.

18 Claims, 9 Drawing Sheets

FIG. 6
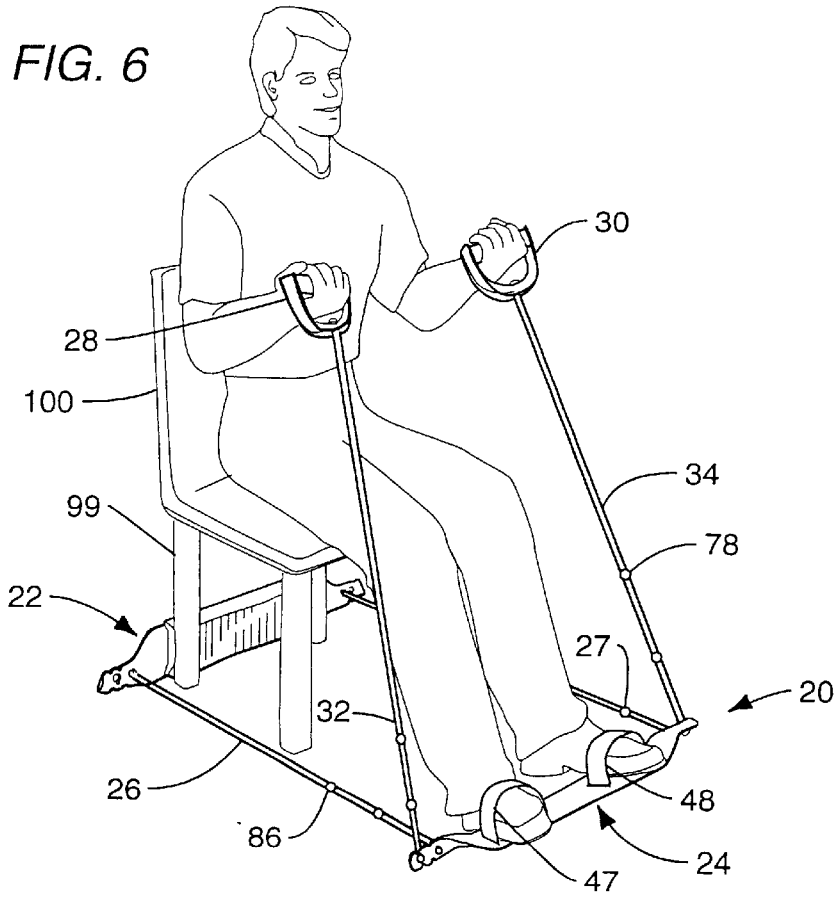
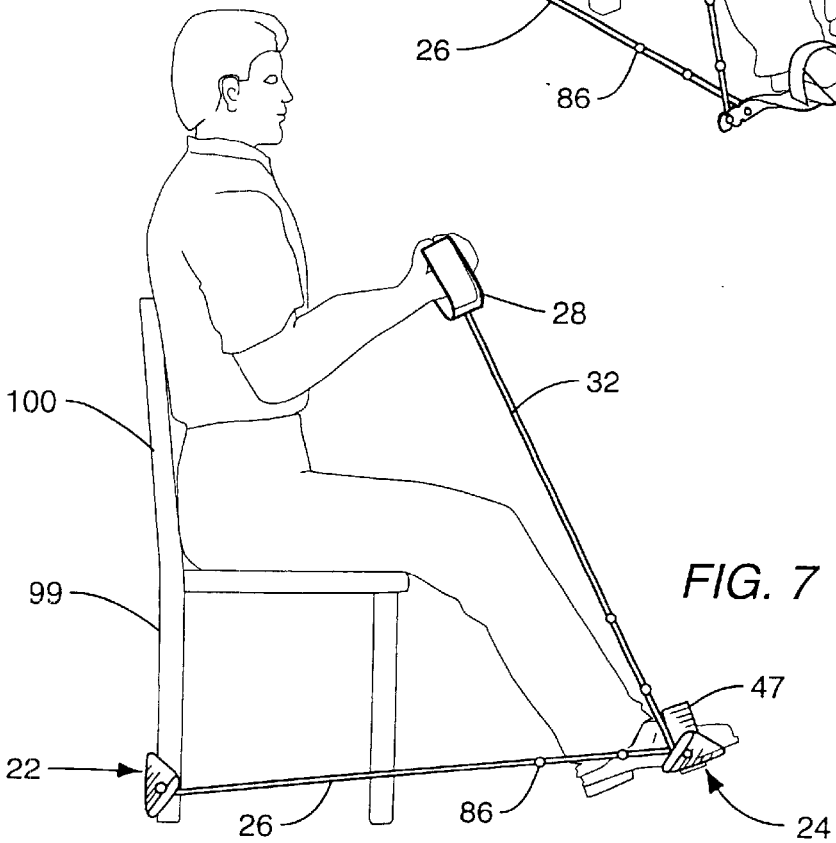
FIG. 7

EXERCISE DEVICE

FIELD OF THE INVENTION

This invention relates to exercise devices and, more particularly, exercise devices which permit mutually independent movement of a user's arms and legs.

BACKGROUND OF THE INVENTION

Many exercise devices are known which permit a user to move the user's arms or legs in such a manner that the arms or legs, as the case may be, are strengthened due to such movement. Typically, however, known exercise devices permit movement of only the user's legs, or only the user's arms. An exercise device which permits movement of the user's arms and legs would enable the user to minimize the time spent exercising.

Exercise devices which permit simultaneous movement of the user's arms and legs are known. For example, U.S. Pat. No. 5,076,576 (Johnson) discloses a therapeutic leveraging device for use in straightening or flexing a kneejoint of the human body. The therapeutic leveraging device disclosed is for use with only one leg. The therapeutic leveraging device includes a harness to which an end of a line cord is anchored. The line cord passes through a pulley block secured to an ankle cuff to handles attached to the user's hands. Because the line cord connects the relevant portions of the device through pulleys, movement of the user's leg in the device requires corresponding, simultaneous movement of the user's arms. The therapeutic leveraging device does not permit mutually independent movement of the user's arms and legs.

U.S. Pat. No. 821,783 (Clease) discloses an apparatus including a collar, grips and stirrups, which permits a user to move the user's arms and legs simultaneously. The collar is fitted around the user's neck, and the user's hands and feet are inserted into the grips and stirrups respectively. However, as disclosed, a single cord connects the collar, the grips and the stirrups. The apparatus does not permit mutually independent movement of the user's arms and legs.

There is therefore a need for an exercise device which can be used to exercise the user's arms and legs mutually independently.

SUMMARY OF THE INVENTION

In a broad aspect of the present invention, there is provided an exercise device comprising an elongate anchor bar assembly for anchoring the exercise device and an elongate foot bar assembly which is movable relative to the anchor bar assembly. The foot bar assembly has at least one foot restrainer for restraining a user's feet. The exercise device also includes a foot coupling assembly for connecting the foot bar assembly to the anchor bar assembly. The foot coupling assembly has at least one anchor end attached to the anchor bar assembly and at least one foot bar end attached to the foot bar assembly. The exercise device also includes a hand grip and a pair of hand coupling members. Each hand coupling member has a secured end and a free end, each secured end being attached to one of the anchor bar assembly and the foot bar assembly, and the free ends being attached to the hand grip, so that the hand grip is movable relative to the anchor bar assembly and the foot bar assembly.

BRIEF DESCRIPTION OF THE DRAWINGS

The invention will be better understood with reference to the drawings, in which:

FIG. 6 is an isometric view of the exercise device of FIG. 1 in which the user is using the exercise device while positioned in a chair;

FIG. 7 is a side view of the user and the exercise device of FIG. 6;

BRIEF DESCRIPTION OF THE PREFERRED EMBODIMENT(S)

Figure 1:
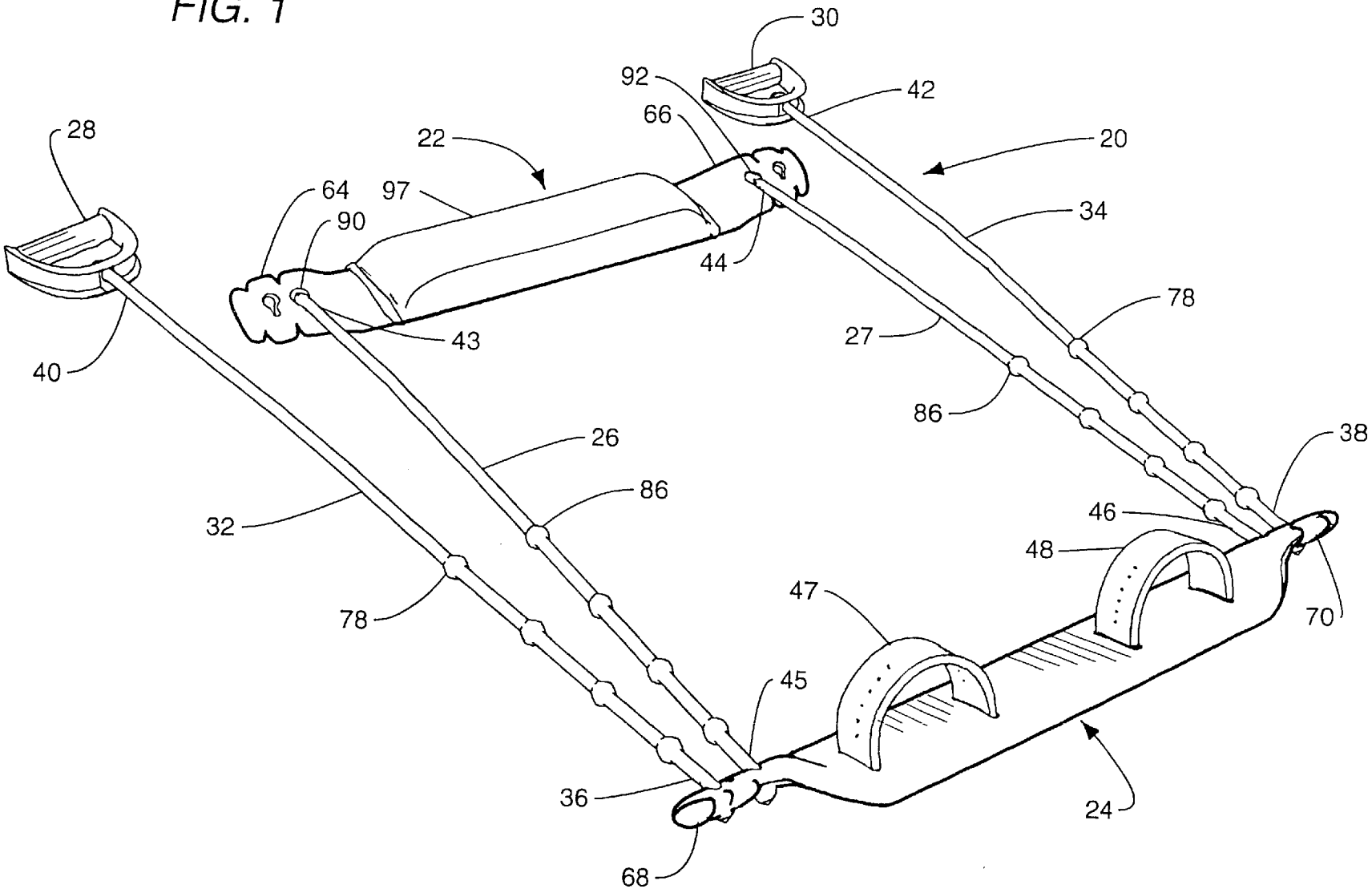
FIG. 1 is an isometric view of a preferred embodiment of the exercise device, including an anchor bar assembly and a foot bar assembly.

Reference is first made to FIG. 1 to describe a preferred embodiment of an exercise device indicated generally by the numeral 20 in accordance with the invention. The exercise device 20 includes an elongate anchor bar assembly 22 for anchoring the exercise device 20, an elongate foot bar assembly 24 movable relative to the anchor bar assembly 22, a foot coupling assembly comprising a pair of foot coupling members 26, 27 for connecting the foot bar assembly 24 to the anchor bar assembly 22, a hand grip comprising a pair of hand receiving members 28, 30, and a pair of hand coupling members 32, 34. As can be seen in FIG. 1, the hand coupling members have secured ends 36, 38 and free ends 40, 42. The secured ends 36, 38 are shown attached to the foot bar assembly 24 in FIG. 1. FIG. 1 shows the hand receiving members 28, 30 attached to respective free ends 40, 42, so that each of the hand receiving members 28, 30 is movable relative to the anchor bar assembly 22 and the foot bar assembly 24. As shown in FIG. 1, the foot coupling members 26, 27 have anchor bar ends 43, 44 attached to the anchor bar assembly 22 and foot bar ends 45, 46 attached to the foot bar assembly 24.

Also as shown in FIG. 1, the foot bar assembly 24 has a foot restrainer in the form of two feet restrainers 47, 48 which are longitudinally spaced from each other on the foot bar assembly 24 to restrain a user's feet.

While various other arrangements could be employed, in the construction shown in FIGS. 1 through 8 and FIG. 10, the foot coupling assembly 26 comprises a pair of foot coupling members 26, 27. As shown in FIGS. 1 through 8 and FIG. 10, the anchor bar ends 43, 44 are attached to respective ends 64, 66 of the anchor bar assembly 22 and the foot bar ends 45, 46 are attached to respective ends 68, 70 of the foot bar assembly 24.

Preferably, the anchor bar assembly 22 and the foot bar assembly 24 are sufficiently long that the user can, while using the exercise device 20, substantially avoid contacting the hand coupling members 32, 34 with the user's body. This aspect can be seen in FIGS. 4 through 7. For example, an anchor bar assembly and a foot bar assembly of approximately three feet in length is sufficiently long for many users.

Various forms of foot coupling members can be employed. It is preferable that the foot coupling members 26, 27 be at least partially resilient, and it is also preferable that the hand coupling members 32, 34 be at least partially resilient. Preferably, and as shown in FIGS. 1 through 8 and 11, all of the hand coupling members 32, 34 and the foot coupling members 26, 27 are elastomers.

Various arrangements can be used to attach the secured ends 36, 38 to the foot bar assembly 24. Also, various arrangements can be used to attach the anchor bar ends 43, 44 to the anchor bar assembly 22, and to attach the foot bar ends 45, 46 to the foot bar assembly 24 as well. It is preferred that the hand coupling members 32, 34 are elastomers having nodes 78, and that the foot bar assembly 24 has keyholes 82, 84 at respective ends 68, 70 thereof in which the nodes 78 are receivable and retainable. Each node 78 is substantially the same size, and has a diameter greater than the diameter of the elastomer. Because of this arrangement, the hand coupling members 32, 34 can be coupled to the foot bar assembly 24 at selected nodes 78 disposed along the length of the hand coupling members 32, 34, thereby permitting adjustment of the separation between the hand receiving members 28, 30 and the respective secured ends 36, 38. This configuration is shown in FIGS. 1 through 9.

It is also preferable that the foot coupling members 26, 27 are elastomers having nodes 86 spaced along the length thereof, each node 86 being substantially the same size and having a diameter greater than the diameter of the elastomer. In a preferred embodiment, respective ends 64, 66 of anchor bar assembly 22 have keyholes 90, 92 disposed therein respectively, and respective ends 68, 70 of foot bar assembly 24 have keyholes 94, 96 disposed therein respectively, in which the nodes 86 are receivable and retainable.

As can be seen in FIGS. 1 through 10, the foot coupling members 26, 27 can be coupled to the anchor bar assembly 22 and the foot bar assembly 24 at selected nodes 86 disposed along the length of the foot coupling members 26, 27. This permits adjustment of the separation between the anchor bar assembly 22 and the foot bar assembly 24.

Figure 2:
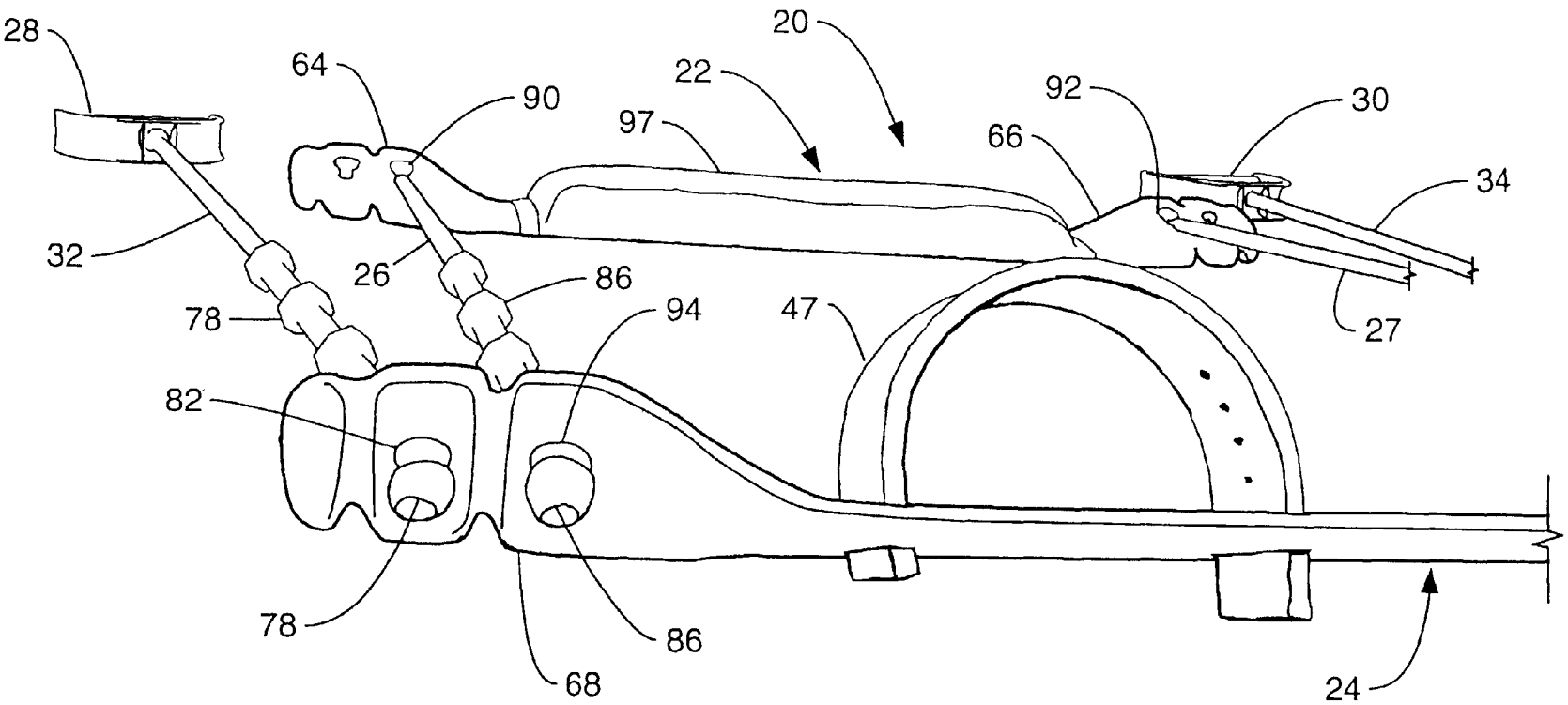
FIG. 2 is an isometric view of the exercise device of FIG. 1 showing a part of a back portion of the foot bar assembly.
Figure 3:
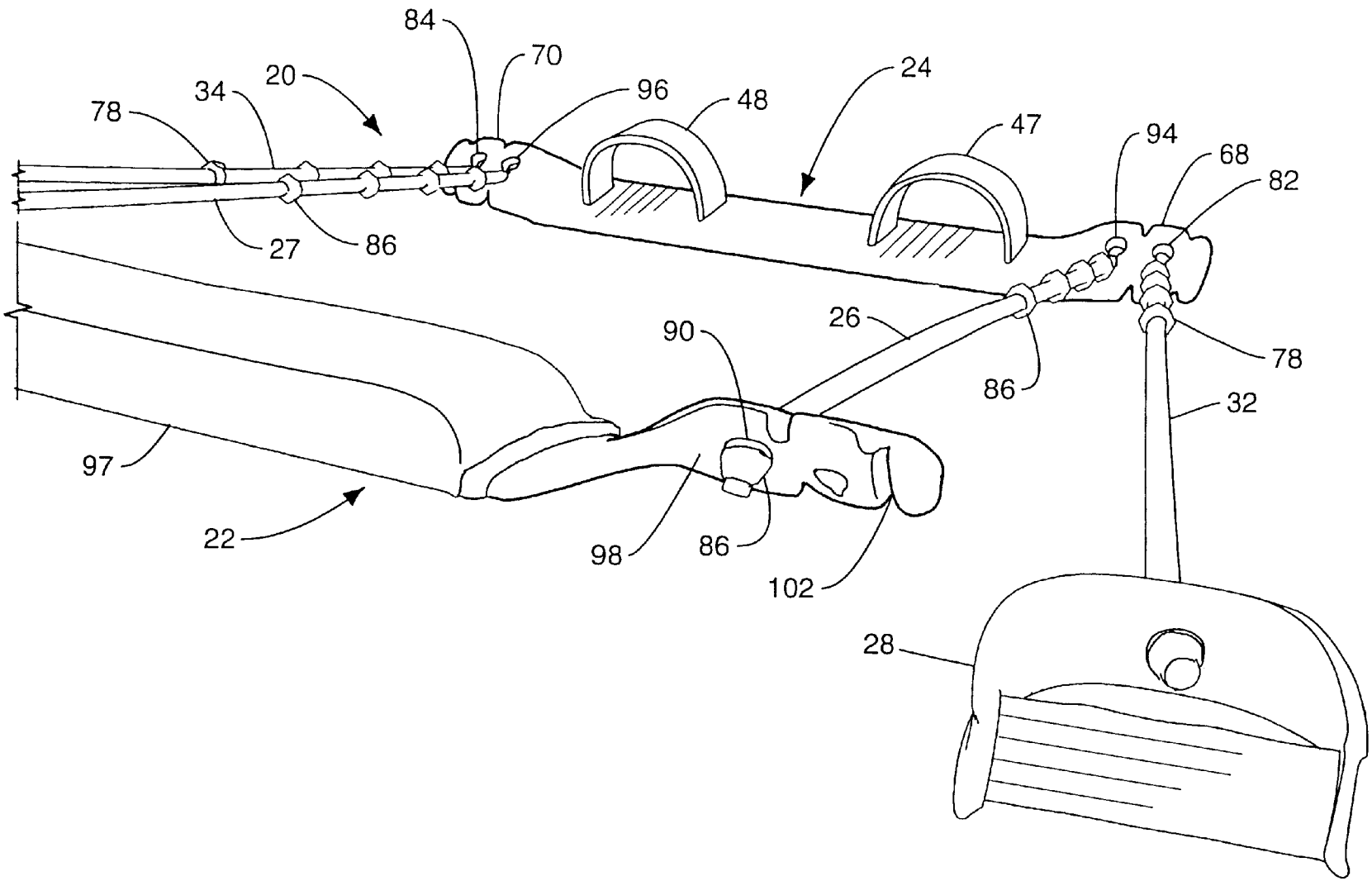
FIG. 3 is an isometric view of the exercise device of FIG. 1 showing a part of a back portion of the anchor bar assembly, showing a locating groove disposed on the back portion.

The position of the node 78 when retained in keyhole 82 can be seen in FIG. 2, which is also representative of the manner in which the nodes 86 can be retained in the keyholes 90, 92, 94, and 96. Similarly, the position of the node 86 when retained in the keyhole 94 is shown in FIG. 3.

Various forms of the hand grip can be employed. In FIGS. 1 through 11, the hand grip is shown as comprising two hand receiving members 28, 30. Alternatively, the hand grip may comprise an elongate bar (not shown) attached to and extending between the free ends 40, 42.

Preferably, the anchor bar assembly 22 includes a cushion 97 disposed substantially along the length of the anchor bar assembly 22.

It is preferable that the anchor bar assembly 22 and the foot bar assembly 24 be formed so as to be substantially similar, as shown in FIG. 1, except for the cushion 97 and the feet restrainers 47 and 48. This facilitates the manufacture of the exercise device 20.

Figure 4:
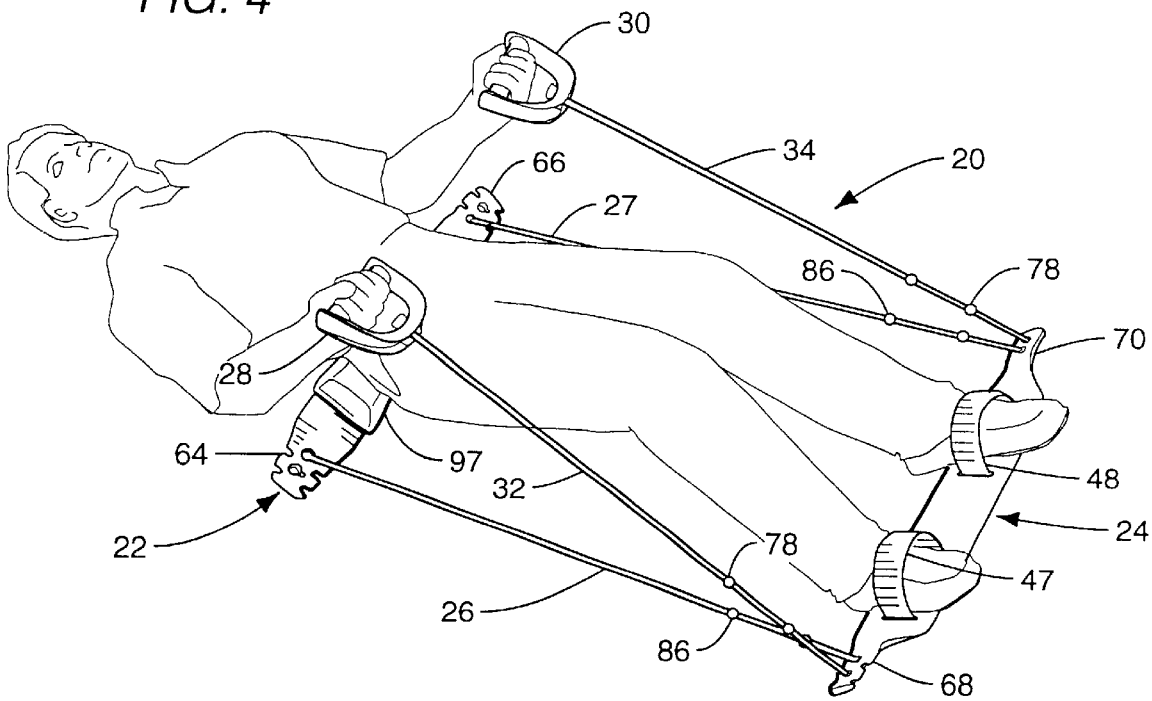
FIG. 4 is an isometric view of the exercise device of FIG. 1 in which a user is using the exercise device while in a prone position.
Figure 5:
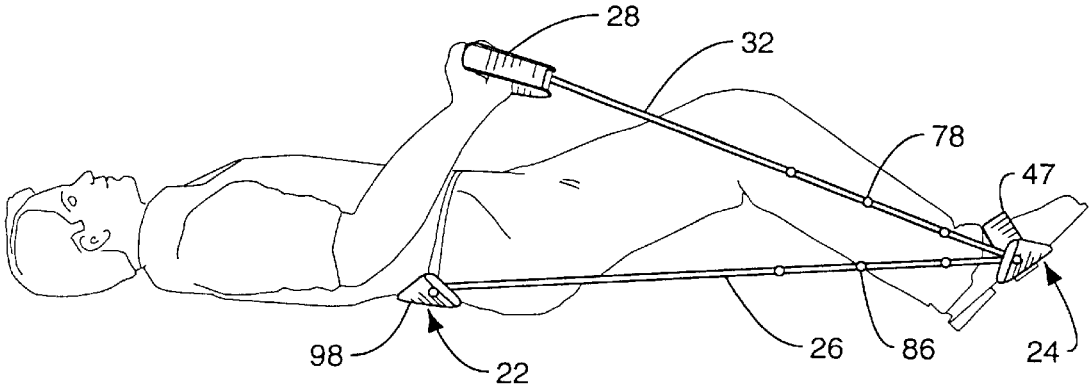
FIG. 5 is a side view of the user and the exercise device of FIG. 4.
Figure 8:
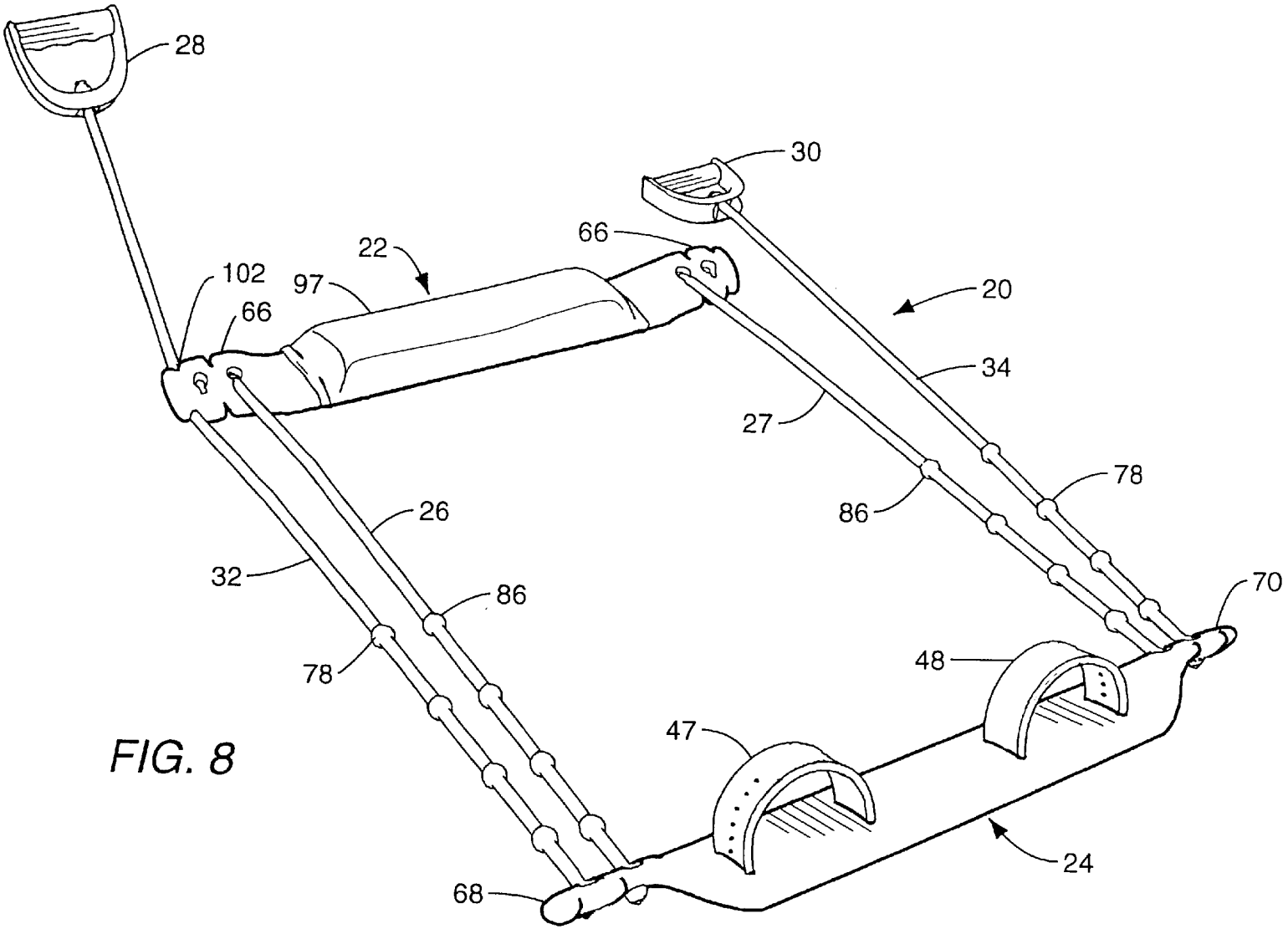
FIG. 8 is an isometric view of the exercise device of FIG. 1 showing a coupling member with a secured end thereof attached to the foot bar assembly, the coupling member being guided by the locating groove on the back portion of the anchor bar assembly.

The exercise device 20 can be used in many different ways. For example, in FIGS. 4 and 5, the exercise device 20 is shown being used by a user while the user is in a prone position. It can be seen in FIGS. 4 and 5 that, because the hand coupling members 32, 34 and the foot coupling members 26, 27 are separately attached to the foot bar assembly 24, the user may move the user's legs while holding the hand receiving members 28, 30 in a static position, or alternately, the user may exercise the user's arms by moving the hand receiving members 28, 30 while holding the foot bar assembly 24 in a static position with the user's feet. In addition, the user may exercise the user's arms and legs simultaneously, by moving the foot bar assembly 24 relative to the anchor bar assembly 22 while at the same time moving the hand receiving members 28, 30 relative to the foot bar assembly 24 and the anchor bar assembly 22. As shown in FIGS. 4 and 5, the cushion 97 is disposed on the anchor bar assembly 22 to protect the user's back when the exercise device 20 is used when the user is in a prone position.

Because adjustment of the separation between the anchor bar assembly 22 and the foot bar assembly 24 and adjustment of the separation between the hand receiving members 28, 30 and the foot bar assembly 24 are permitted, the exercise device 20 is adjustable to accommodate the different body sizes of various users. In addition, the manner in which the hand coupling members 32, 34 are coupled to the foot bar assembly 24, and the manner in which the foot coupling members 26, 27 are coupled to the anchor bar assembly 22 and the foot bar assembly 24, enables the user to substitute readily elastomers providing greater or lesser amounts of resistance, as required.

To demonstrate one of the many other ways in which the exercise device 20 can be used, an alternative method of using the exercise device 20 is shown in FIGS. 6 and 7, as another example. As shown in FIG. 6, the anchor bar assembly 22 is placed against the rear legs 99 of a chair 100, and the anchor bar assembly 22 is maintained there by tension in foot coupling members 26, 27 when the user causes the foot coupling members 26, 27 to stretch by moving the foot bar assembly 24 with the user's legs. The user, seated in the chair 100, can exercise the user's legs by causing the foot bar assembly 24 to move relative to the anchor bar assembly 22. Also, the user can exercise the user's arms by causing the hand receiving members 28, 30 to move relative to the foot bar assembly 24 and the anchor bar assembly 22. In addition, if desired, the user may move the user's legs, causing the foot bar assembly 24 to move relative to anchor bar assembly 22, and simultaneously move the user's arms, causing the hand receiving members 28, 30 to move relative to the foot bar assembly 24 and the anchor bar assembly 22. It is preferred that the user keep the hand receiving members 28, 30 in relatively lower positions with respect to the rest of the user's body, as this would also tend to assist in maintaining the anchor bar assembly 22 in position against the rear legs 99. If the user has concerns about the anchor bar assembly 22 moving upwardly when the exercise device 20 is in use, then auxiliary anchoring means (not shown) maybe provided to hold the anchor bar assembly 22 in place against the rear legs 99.

As can be seen in FIG. 3, the anchor bar assembly 22 has at least two locating grooves 102 longitudinally spaced from each other on the anchor bar assembly 22 and disposed on a back portion 98 of the anchor bar assembly 22. One of the locating grooves 102 is shown in FIG. 3. Where the user wishes to do a "bench press" type of exercise, the user can couple the hand coupling members 32, 34 to respective ends of the anchor bar assembly 22, by causing the hand coupling members 32, 34 to be guided by the locating grooves 102. A hand coupling member 32 is shown coupled to the anchor bar assembly 22 by one of the locating grooves 102 in FIG. 8.

Figure 9:
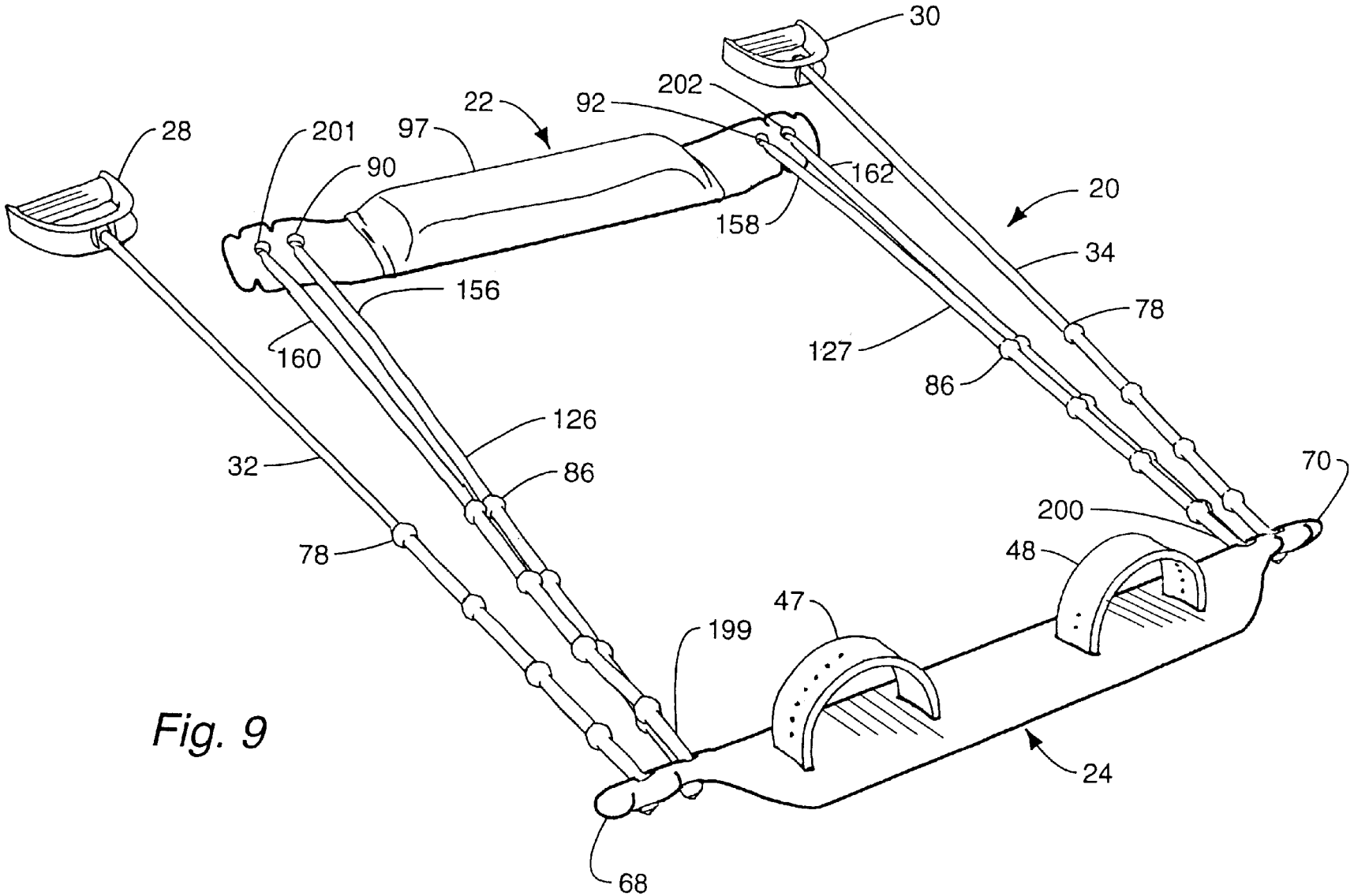
FIG. 9 is an isometric view of another embodiment of an exercise device according to the invention.
Figure 10:
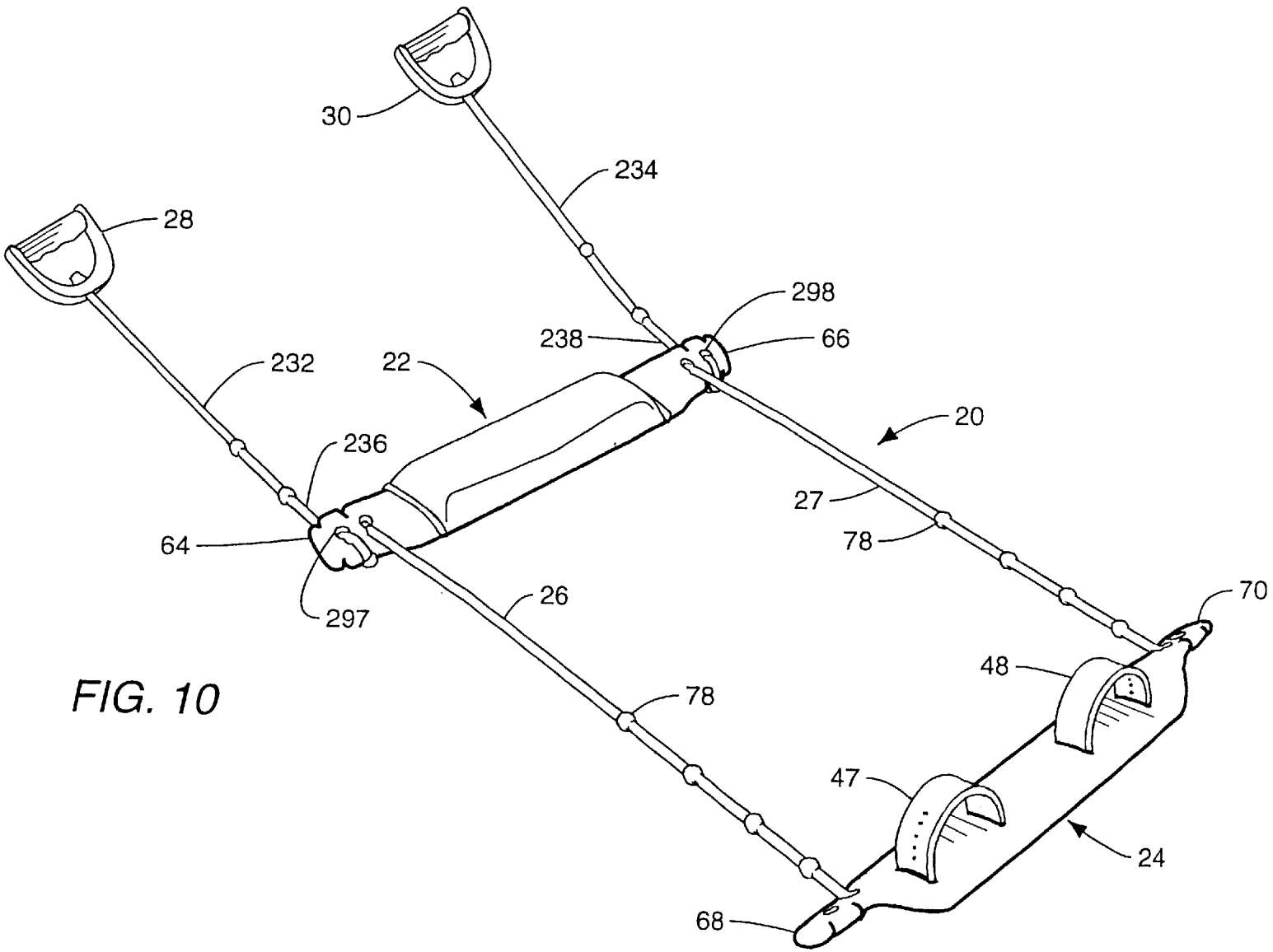
FIG. 10 is an isometric view of yet another embodiment of an exercise device according to the invention.
Figure 11:
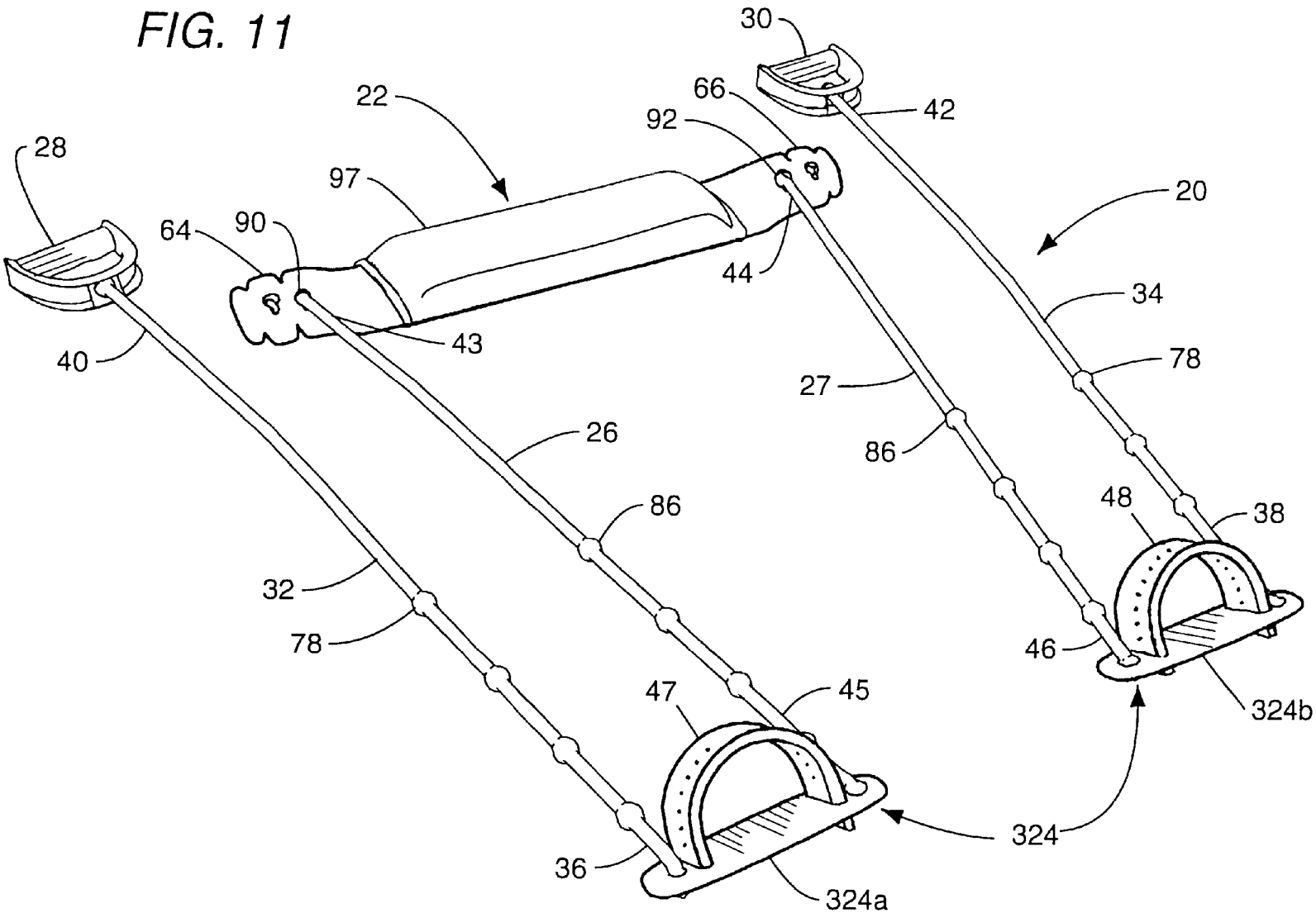
FIG. 11 is an isometric view of another embodiment of an exercise device according to the invention.

Additional preferred embodiments of the invention are shown in FIGS. 9, 10, and 11. In FIGS. 9, 10, and 11, elements are numbered so as to correspond to like elements shown in FIGS. 1 through 8.

To create the embodiment shown in FIG. 9, the first ends 156, 158 of the foot coupling members 126, 127 are retained in keyholes 90, 92. It can be seen from FIG. 9 that the foot coupling members 126, 127 are longer than the foot coupling members 26, 27 shown in FIGS. 1 through 8 inclusive. The foot coupling members 126, 127 have second ends 160, 162. Each foot coupling member has intermediate portions 199, 200 between each first end 156, 158 and each second end 160, 162. The intermediate portions 199, 200 are coupled to respective ends 68, 70 of the foot bar assembly 24. Second ends 160, 162 of the foot coupling members 126, 127 are retained in anchor bar keyholes 201, 202. In this embodiment, because the foot coupling members 126, 127 are extended twice between the anchor bar assembly 22 and the foot bar assembly 24, the resistance provided by the foot coupling members 126, 127 is much greater than the resistance which would be provided by the foot coupling members 126, 127 if the foot coupling members 126, 127 were attached to the anchor bar assembly 22 and the foot bar assembly 24 so that the foot coupling members 126, 127 were extended only once between the anchor bar assembly 22 and the foot bar assembly 24.

In FIG. 10, another embodiment is shown in which hand coupling members 232, 234 have secured ends 236, 238 which are attached to the ends 64, 66 of the anchor bar assembly 22 in keyholes 297, 298. The user may prefer to use the exercise device 20 in this embodiment where, for example, the user wishes to exercise the user's arms as in the exercise commonly referred to as a "shoulder press", when the user is in a prone position. The embodiment shown in FIG. 10 may be preferred, for example, where the user wishes to have greater resistance to movement of the arms than to movement of the legs.

Another embodiment is shown in FIG. 11, in which a foot bar assembly 324 includes two separate foot bar portions 324*a*, 324*b*. One of the user's feet is receivable in each of the foot bar portions 324*a*, 324*b*. The foot bar portions 324*a*, 324*b* have feet restrainers 47, 48. As can be seen in FIG. 11, the foot bar portions 324*a*, 324*b* are connected to respective foot bar ends 45, 46 of the foot coupling members 26, 27. Anchor bar ends 43, 44 of the foot coupling members 26, 27 are attached to respective ends 64, 66 of anchor bar assembly 22. Also, the secured ends 36, 38 of hand coupling members 32, 34 are attached to respective foot bar portions 324*a*, 324*b*. The embodiment shown in FIG. 11 includes hand receiving members 28, 30 attached to respective free ends 40, 42 of the hand coupling members 32, 34, so that each of the hand grips 28, 30 is movable relative to the of anchor bar assembly 22 and the foot bar assembly 324.

The embodiment shown in FIG. 11 could be used where separate movement of the user's legs is necessary or desirable. This embodiment may be used, for example, where the user wishes to exercise one of the user's legs, or the user's legs separately, for therapeutic purposes. Because the foot bar portions 324*a*, 324*b* are separate, this embodiment permits the use of foot coupling members 26, 27 which offer substantially differing amounts of resistance.

Different elastomers, providing different amounts of resistance, and also of different lengths, may be used as foot coupling members 26, 27 or as hand coupling members 32, 34. For example, the user can readily adjust the exercise device 20 so that significantly greater resistance is provided to movement of the user's legs (i.e., by the foot coupling members 26, 27) than to movement of the user's arms (i.e., by hand coupling members 32, 34), or vice versa. Because the elastomers are releasably attachable, they can readily be removed and replaced by other elastomers to provide a desired degree of resistance.

Many other configurations not specifically disclosed herein may occur to those skilled in the art, and would be different forms of the invention disclosed. For example, a user may wish to insert a rod (not shown) through the hand receiving members 28, 30 and attach the hand receiving members 28, 30 to the rod. This would permit the use of the rod, as a hand grip, like a barbell in a "bench press" exercise, where the user is using the exercise device 20 while in a prone position.

In use, exercise device 20 can be used in many ways, in addition to the exercises shown in FIGS. 4 to 7. For example, a user may use the exercise device 20 with only one foot in the feet restrainers 47, 48. The user could also use the exercise device 20 with one hand, in one of the hand receiving members 28, 30. Also, although the anchor bar assembly 22 is preferably located under the user's lumbar area when the exercise device 20 is used as shown in FIGS. 4 and 5, the user may prefer to position the anchor bar assembly 22 closer to the user's shoulders, under the user's back, for example, when the user is using the exercise device 20 in the configuration shown in FIG. 8, in "bench press" exercises.

It will be evident to those skilled in the art that the invention can take many forms, and that such forms are within the scope of the invention as claimed. For example, a plurality of keyholes may be created in the anchor bar assembly 22 and the foot bar assembly 24, to facilitate extending connecting members between the anchor bar assembly 22 and the foot bar assembly 24 more than twice. Also, different methods of releasably attaching the connecting members to the anchor bar assembly 22 and the foot bar assembly 24 respectively, maybe used. Similarly, alternate means of attaching the secured ends of the coupling members to the foot bar assembly 24 or the anchor bar assembly 22, as required, may be used. Therefore, the spirit and scope of the appended claims should not be limited to the description of the preferred versions contained herein.

I claim:

1. An exercise device having:

an elongate anchor bar assembly for anchoring the exercise device;

an elongate foot bar assembly movable relative to the anchor bar assembly, the foot bar assembly having at least one foot restrainer for restraining a user's feet;

a resilient foot coupling assembly for connecting the foot bar assembly to the anchor bar assembly, the foot coupling assembly having at least one anchor end attached to the anchor bar assembly and at least one foot bar end attached to the foot bar assembly;

a hand grip; and a pair of resilient hand coupling members, each hand coupling member having a secured end and a free end, each secured end being attached to one of the anchor bar assembly and the foot bar assembly and the free ends being attached to the hand grip, such that the hand grip is movable relative to the anchor bar assembly and the foot bar assembly, whereby the foot coupling assembly is adapted to allow relative movement between the foot bar assembly and the anchor bar assembly so that the user can exercise the user's arms and legs simultaneously.

2. An exercise device as defined in claim 1 wherein the hand grip comprises a pair of hand receiving members, each hand receiving member being attached to a respective free end of the hand coupling members.

3. An exercise device as defined in claim 1 wherein the foot bar assembly includes two foot restrainers longitudinally spaced from each other on the foot bar assembly.

4. An exercise device as defined in claim 1 wherein the foot coupling assembly has a pair of foot coupling members, each foot coupling member having an anchor bar end and a foot bar end, the anchor bar ends being attached to respective ends of the anchor bar assembly and the foot bar ends being attached to respective ends of the foot bar assembly, and wherein the anchor bar assembly and the foot bar assembly are each sufficiently long that the user can substantially avoid contacting the foot coupling members.

5. An exercise device as defined in claim 1 wherein the foot coupling assembly is releasably attachable to adjust the separation between the anchor bar assembly and the foot bar assembly, and thereby to modify said separation to accommodate the user and to vary any resistance to the user's legs.

6. An exercise device as defined in claim 1 wherein the hand coupling members are releasably attachable to adjust the distance between the hand grip and the respective secured ends, and thereby to modify said distance to accommodate the user and to vary any resistance to the user's arms.

7. An exercise device as defined in claim 4 wherein the anchor bar assembly has at least two locating grooves longitudinally spaced from each other on the anchor bar assembly and disposed on a back portion thereof for coupling the hand coupling members to respective ends of the anchor bar assembly.

8. An exercise device as defined in claim 1 in which the anchor bar assembly includes a cushion disposed substantially along the length of the anchor bar assembly.

9. An exercise device having:

an elongate anchor bar assembly for anchoring the exercise device;

an elongate foot bar assembly having at least one foot restrainer for restraining a user's feet, the foot bar assembly being movable relative to the anchor bar assembly;

a pair of foot coupling elastomers for connecting the foot bar assembly to the anchor bar assembly, each foot coupling elastomer having a first end and a second end and an intermediate portion between said first end and said second end, said first end and said second end being coupled to a respective end of the anchor bar assembly and said intermediate portion being coupled to an opposing end of the foot bar assembly;

a pair of hand receiving members;

a pair of hand coupling elastomers, each hand coupling elastomer having a secured end and a free end, each secured end being attached to one of the anchor bar assembly and the foot bar assembly; and the hand receiving members being attached to the respective free ends, such that each of the hand receiving members is movable relative to the anchor bar assembly and the foot bar assembly, whereby the foot coupling elastomers are adapted to allow relative movement between the foot bar assembly and the anchor bar assembly so that the user can exercise the user's arms and legs simultaneously.

10. An exercise device having:

an elongate anchor bar assembly for anchoring the exercise device;

an elongate foot bar assembly having two foot restrainers for restraining a user's feet, the foot bar assembly being movable relative to the anchor bar assembly;

a pair of foot coupling elastomers for connecting the foot bar assembly to the anchor bar assembly, each foot coupling elastomer having an anchor bar end and a foot bar end, said anchor bar ends being attached to respective ends of the anchor bar assembly, and said foot bar ends being attached to respective ends of the foot bar assembly;

a pair of hand receiving members; and a pair of hand coupling elastomers, each hand coupling elastomer having a secured end and a free end, said secured ends being attached to respective ends of the anchor bar assembly and the free ends being attached to the hand receiving members respectively, such that each of the hand receiving members is movable relative to the anchor bar assembly and the foot bar assembly, whereby the foot coupling elastomers are adapted to allow relative movement between the foot bar assembly and the anchor bar assembly so that the user can exercise the user's arms and legs simultaneously.

11. An exercise device as defined in claim 10 wherein the anchor bar assembly has at least four keyholes, pairs of said keyholes being disposed at both ends of the anchor bar assembly.

12. An exercise device as defined in claim 10 wherein the foot bar assembly has at least four keyholes, pairs of said keyholes being disposed at both ends of the foot bar assembly.

13. An exercise device having:

an elongate anchor bar assembly for anchoring the exercise device;

an elongate foot bar assembly having at least one foot restrainer for restraining a user's feet, the foot bar assembly being movable relative to the anchor bar assembly;

a pair of foot coupling elastomers for connecting the foot bar assembly to the anchor bar assembly, each foot coupling elastomer having an anchor bar end and a foot bar end, said anchor bar ends being attached to respective ends of the anchor bar assembly, and said foot bar ends being attached to respective ends of the foot bar assembly such that the foot coupling elastomers extend between opposing respective ends of the anchor bar assembly and the foot bar assembly;

a pair of hand receiving members;

a pair of resilient hand coupling members comprising elastomers, each hand coupling member having a secured end and a free end, the secured ends being attached to respective ends of the foot bar assembly; and the hand receiving members being attached to the respective free ends, such that each of the hand receiving members is movable relative to the anchor bar assembly and the foot bar assembly, whereby the foot coupling elastomers are adapted to allow relative movement between the foot bar assembly and the anchor bar assembly so that the user can exercise the user's arms and legs simultaneously.

14. An exercise device having:

an elongate anchor bar assembly for anchoring the exercise device;

an elongate foot bar assembly having at least one foot restrainer for restraining a user's feet, the foot bar assembly being movable relative to the anchor bar assembly;

a pair of foot coupling elastomers for connecting the foot bar assembly to the anchor bar assembly, each foot coupling elastomer having an anchor bar end and a foot bar end, said anchor bar ends being attached to respective ends of the anchor bar assembly, and said foot bar ends being attached to respective ends of the foot bar assembly such that the foot coupling elastomers extend between opposing respective ends of the anchor bar assembly and the foot bar assembly;

a pair of hand receiving members;

a pair of resilient hand coupling members comprising elastomers, each hand coupling member having a secured end and a free end, the secured ends being attached to respective ends of the foot bar assembly;

the anchor bar assembly having at least two locating grooves longitudinally spaced from each other on the anchor bar assembly and disposed on a back portion thereof, for coupling intermediate portions of the hand coupling members to respective ends of the anchor bar assembly; and the hand receiving members being attached to the respective free ends, such that each of the hand receiving members is movable relative to the anchor bar assembly and the foot bar assembly, whereby the foot coupling elastomers are adapted to allow relative movement between the foot bar assembly and the anchor bar assembly so that the user can exercise the user's arms and legs simultaneously.

15. A kit of parts for an exercise device for exercising a user's legs and arms mutually independently, having:

an elongate anchor bar assembly for anchoring the exercise device;

an elongate foot bar assembly having at least one adjustable foot restrainer for restraining the user's feet;

a pair of resilient connecting members, each connecting member having an anchor bar end and a foot bar end, each anchor bar end and each foot bar end being releasably attachable to the anchor bar assembly and the foot bar assembly respectively;

a pair of hand receiving members; and a pair of resilient coupling members, each coupling member having a first end releasably attachable to one of the foot bar assembly and the anchoring assembly, and a second end, the second ends being attachable to the hand receiving members respectively, whereby the resilient connecting members are adapted to allow relative movement between the foot bar assembly and the anchor bar assembly, when the connecting members are attached to the anchor bar assembly and the foot bar assembly, so that the user can exercise the user's arms and legs simultaneously.

16. An exercise device having:

an elongate anchor bar assembly for anchoring the exercise device;

a pair of foot bar portions movable relative to each other, and movable relative to the anchor bar assembly, each foot bar portion having at least one foot restrainer for restraining a user's foot;

a pair of resilient foot coupling members, each foot coupling member having an anchor bar end and a foot bar end, the anchor bar ends being attached to respective ends of the anchor bar assembly and the foot bar ends being attached to respective foot bar portions;

a pair of hand receiving members; and a pair of resilient hand coupling members, each hand coupling member having a secured end and a free end, the secured ends being attached to respective foot bar portions and the hand receiving members being attached to the free ends respectively, such that each of the hand receiving members is movable relative to the anchor bar assembly and the foot bar portions, whereby the foot coupling members are adapted to allow relative movement between the foot bar portions and relative movement between the foot bar portions and the anchor bar assembly so that the user can exercise the user's arms and legs simultaneously.

17. An exercise device having:

an elongate anchor bar assembly for anchoring the exercise device;

an elongate foot bar assembly movable relative to the anchor bar assembly, the foot bar assembly having at least one foot restrainer for restraining a user's feet;

a pair of resilient foot coupling members for connecting the foot bar assembly to the anchor bar assembly, each foot coupling member having an anchor bar end and a foot bar end, the anchor bar ends being attached to respective ends of the anchor bar assembly and the foot bar ends being attached to respective ends of the foot bar assembly;

a hand grip;

a pair of resilient hand coupling members, each hand coupling member having a secured end and a free end, each secured end being attached to one of the anchor bar assembly and the foot bar assembly and the free ends being attached to the hand grip, such that the hand grip is movable relative to the anchor bar assembly and the foot bar assembly;

each of the anchor bar assembly and the foot bar assembly having a pair of keyholes therein for the attachment of the foot coupling members and the hand coupling members respectively; and each foot coupling member being an elastomer having nodes spaced along the length thereof, each node being substantially the same size and having a diameter greater than the diameter of the elastomer, and each node being sized such that each node is receivable and retainable in said keyholes, such that the foot coupling members can be coupled to the anchor bar assembly and the foot bar assembly at selected nodes along the lengths thereof, thereby permitting adjustment of the separation between the anchor bar assembly and the foot bar assembly, whereby the foot coupling elastomers are adapted to allow relative movement between the foot bar assembly and the anchor bar assembly so that the user can exercise the user's arms and legs simultaneously.

18. An exercise device according to claim 17 in which each hand coupling member is an elastomer having nodes spaced along the length thereof, each node being substantially the same size and having a diameter greater than the diameter of the elastomer, each node being sized such that each node is receivable and retainable in said keyholes, such that the hand coupling members can be coupled to one of the anchor bar assembly and the foot bar assembly at selected nodes along the lengths thereof, thereby permitting adjustment of the separation between the anchor bar assembly and the foot bar assembly.

* * * * *